US006456190B1

(12) United States Patent
Andersson et al.

(10) Patent No.: US 6,456,190 B1
(45) Date of Patent: Sep. 24, 2002

(54) DEVICE FOR MICROMECHANICAL SWITCHING OF SIGNALS

(75) Inventors: Gert Andersson, Lindome; David Westberg, Göteborg, both of (SE)

(73) Assignee: Imego AB, Göteborg (SE)

( * ) Notice: Subject to any disclaimer, the term of this patent is extended or adjusted under 35 U.S.C. 154(b) by 0 days.

(21) Appl. No.: 09/530,464

(22) PCT Filed: Oct. 29, 1998

(86) PCT No.: PCT/SE98/01971

§ 371 (c)(1),
(2), (4) Date: Jun. 27, 2000

(87) PCT Pub. No.: WO99/22390

PCT Pub. Date: May 6, 1999

(30) Foreign Application Priority Data

Oct. 29, 1997 (SE) ..... 9703969

(51) Int. Cl.[7] ..... H01H 37/46; H01H 37/48

(52) U.S. Cl. ..... 337/365; 337/333; 337/36; 337/53; 337/89

(58) Field of Search ..... 337/333, 36, 53, 337/39, 89, 40, 78, 335, 337, 370, 365; 251/129.02

(56) References Cited

U.S. PATENT DOCUMENTS 1,408,168 A * 2/1922 Buck ..... 337/370
1,705,227 A * 3/1929 Quigley ..... 337/370
2,487,268 A * 11/1949 Oleson ..... 200/137
2,586,309 A * 2/1952 Dales ..... 200/138
3,601,736 A * 8/1971 Sepe ..... 337/101
3,761,855 A * 9/1973 Townsend ..... 337/78
4,303,302 A * 12/1981 Ramsey et al. ..... 350/96.2
4,445,105 A * 4/1984 Wehl ..... 337/94
5,261,015 A * 11/1993 Glasheen ..... 385/23
5,555,972 A * 9/1996 Schwab ..... 200/451
5,712,609 A * 1/1998 Mehregany et al. ..... 337/70
5,796,152 A * 8/1998 Carr et al. ..... 257/415
6,239,685 B1 * 5/2001 Albrecht et al. ..... 337/365

* cited by examiner

*Primary Examiner*—Anatoly Vortman
(74) *Attorney, Agent, or Firm*—Michael J. Brown

(57) ABSTRACT

The invention refers to a micromechanical switching device including at least two contact elements (11, 12, 31, 32), which are provided at least partly movable relative each other and via thermal actuation can be closed and opened, whereby the contact elements (11, 12, 31, 32) at least partly are comprised of at least two materials (14, 15, 16, 17, 34–37) with essentially different thermal expansion coefficients. The contact elements (11, 12, 31, 32) at excitation are arranged to displace essentially in same level and in different directions.

20 Claims, 3 Drawing Sheets

DEVICE FOR MICROMECHANICAL SWITCHING OF SIGNALS

TECHNICAL FIELD

The present invention refers to a micromechanical switching device including at least two contact elements, which are provided at least partly movable relative each other and which via thermal actuation can close and open a circuit.

BACKGROUND OF THE INVENTION AND PRIOR ART

It is known to use either bimetal, electrostatic or magnetic force to displace a movable part to contact a fixed part. These are described closer in, e.g., Shifang Zhou et al, "A Micro Variable Inductor Chip Using MEMS Relays", Proc. TRANSDUCERS '97, Chicago Jun. 16–19, 1997, pages 1137–1140 and Sumit Majunder et al, "Measurement and modelling of surface micromachined, electrostatically actuated microswitches", Proc. TRANSDUCERS '97, Chicago Jun. 16–19, 1997, pages 1145–1148 and William P. Taylor et al, "Integrated Magnetic Microrelays: Normally Open, Normally Closed, and Multi-pole", Proc. TRANSDUCERS '97, Chicago Jun. 16–19, 1997, pages 1149–1152. Also, a combination of bimetal and electrostatic force has been demonstrated (Shifang Zhou et al, "A Micro Variable Inductor Chip Using MEMS Relays", Proc. TRANSDUCERS '97, Chicago Jun. 16–19, 1997, pages 1137–1140), where for the first time, the relatively large displacement, which can be achieved with bimetal was used to electrostatically increase the contact force afterwards. Common for above references is that they always are in an initial position without actuation, either ON or OFF, and to connect an actuation is required and as soon as it is interrupted the switching is reversed to its initial position.

A future application for micromechanical switches is in microwave circuits. Presently, electric switches are usually used, but these are, specially for high-frequency (HF) applications, afflicted with large losses; therefore in many applications it is desirable to exchange these for mechanical switches with low signal losses. Micromechanically produced switches can be integrated into different types of passive and active HF components such as waveguides, coils, capacitances and transistors. The known micromechanical switches, however, require actuation when activated and consequently consume energy when they are not in their initial position, this is a drawback specially when a battery is used for operation.

Through WO 95/34904 a micromechanical memory sensor including two arms is known, which mechanically switch when a threshold value of a variable condition is detected. The mechanical switching can be detected by means of a circuit for read out. Actually, this patent specification describes only a sensor. However, the possibility of using it as a switch is mentioned. No closer description of the switch and its function are expressed. Both at locking and unlocking, an arm is deflected more than the other one and snaps by when sufficient force is obtained. This procedure wears hard on the free ends of the arms and contact surfaces thereof. If a switch operates in this way, it should have very low length of life irrespective of being used to connect signals or not. Furthermore, the built-in tensions are not used in an advantageous way. The built-in tensions are used to calibrate the sensitivity of the sensors. Moreover, both arms according to this document are displaced in same direction when they are excited. Additionally, the manufacturing process according to this document is very complicated. It requires frequent back-etching and double-faced registration.

U.S. Pat. No. 3,761,855 discloses a switch including two thermally controlled arms. The switch is not based on micromechanical technics. The built-in tensions are not used at normal temperature, which implies that in the open position very poor insulation characteristics are obtained. This is very important in both electric (RF) and optical applications. Furthermore, the arms are displaced orthogonally relative to each other, which gives a complicated structure to manufacture, as the arms are arranged in different levels. The method used to interlock the free ends of the arms is complicated and clumsy. This invention is also sensitive for variations in ambient temperature, why temperature compensated arms have been introduced.

THE OBJECT OF THE INVENTION AND ITS FEATURES

One object of the invention is to provide a bistable switch which requires low power consumption and/or has memory function at power failure.

Another object of the invention is to extend the technology of the micromechanical switches to also include bistable switches, which only consume energy at switching and maintain its state at power failure. Yet, one object of the switch according to the present invention is to enable larger insulation distance in an open position than the known types whereas it comprises two movable parts instead of one movable and one stationary. The invention benefits from the privilege of creating switch arms with high intrinsic stress, by using two arms with high oppositely directed intrinsic stress a high contact pressure and a self-locking function in the closed position is obtained. If a further increase of the contact pressure is required, the invention may also be arranged so that an electrostatic increase of the contact pressure can be used.

Yet, one object of the invention is to provide a micromechanical switch in which the excitation pulses are generated in such a way that connection and disconnection is achieved very leniently for the contactors.

Moreover, the invention has an objective to use the built-in tensions in an explicit way to obtain distinguished insulation distance between the contact elements when the switch is in an open position.

When manufacturing a micromechanical switch according to the invention, the order of the appearance of the material in the switching elements is inverted to achieve good insulation distance as the switching elements can be displaced in different directions.

The switching device, according to the invention, is cheap to produce and can be produced through a batch based thin and/or thick film technique.

The switch according to the invention is also considerably less sensitive to variations of the operation temperature through inherent much larger margins in both open and closed positions.

These objectives are obtained by the initially mentioned contact elements at least partly consisting of at least two materials with essentially different thermal expansion coefficients.

BRIEF DESCRIPTION OF THE DRAWINGS

The invention will be described closer below with reference to the enclosed drawings, in which.

DETAILED DESCRIPTION OF EMBODIMENTS

A device according to the invention includes at least two movable elements, realized as arms, which through thermal actuation can close and open a circuit. Suitable material combinations will be chosen so that two resisting switching arms deflect in different directions, for example one of them deflects upwards while the other one deflects downwards at the intended operating temperature and that arms can be arranged to deflect in opposite directions through heating. Moreover, the arms are arranged so that they essentially overlap each other in the position where they should interlock or contact, for example when both arms are straightened and at least one of them through heating could deflect so much that it can be constrained to pass the other arm.

Figure 1:
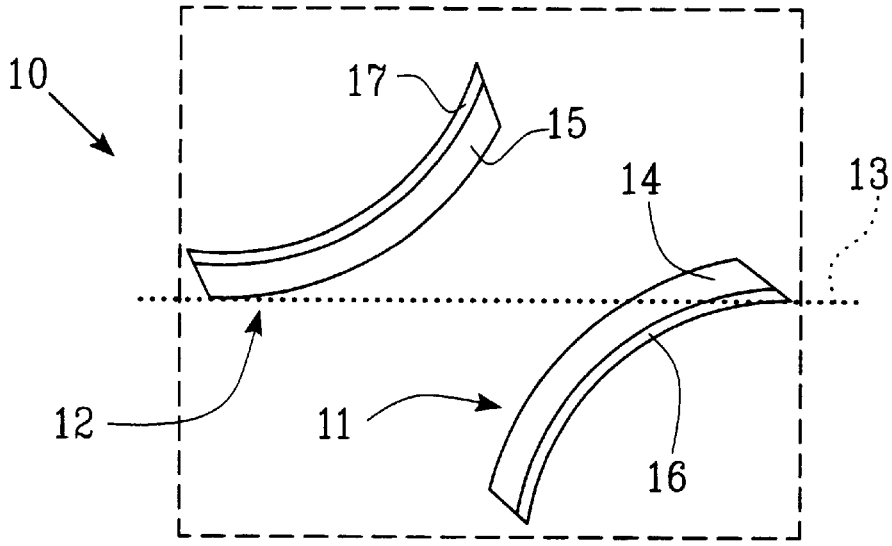
FIG. 1 is a very schematic cross-section of an open, bistable micromechanical switch, according to the invention.

A bistable micromechanical switch 10 is shown in FIG. 1 in an open state and it includes a first and a second switching arm 11 and 12, respectively, provided on or in a conveyer or a substrate (shown with broken and dotted line), for example silica substrate or the like. Each one of arms 11 12, respectively, has such a built-in, essentially high mechanical tension that they are deflected at the operating temperature in opposite directions when no external power is supplied, whereby the first arm 11, e.g. is deflected downwards and the second arm 12 upwards relative line 13. Preferably, each arm comprises a first 14, 15 and a second 16, 17 section of different material and with different thermal expansion coefficients. Clearly, each arm can also consist of different material. Moreover, each arm is secured at one end.

The movable elements of the switches are produced through flexible structures which comprise at least two materials with different thermal expansion coefficients, e.g. aluminum and silicon dioxide, where aluminum has much larger thermal expansion coefficient than the silicon dioxide. Additionally, the aluminum can easily be deposited with built-in tensions at room temperature, while silicon dioxide is simply grown or deposited with built-in compressive stress at room temperature. Thus, a switching arm consisting of Al—$SiO_2$ will be deflected at room temperature and is straightened when it is heated. The heating will be accomplished through conducting a current directly in the aluminum or more preferably through, for example a poly silicon resistor which is deposited onto the entire or a part of the switching arm. The contact elements may also consist of other material with high temperature expansion, for example gold, aluminum, wolfram, copper or the like and material with low temperature expansion, for example silicon nitride or silicon carbide, silicon oxide, aluminium oxide or the like.

A device can for example be manufactured by means of well-known semiconductor manufacturing processes including for instance photolithographic printing, physical and chemical deposition of different materials, isotropic and anisotropic etching, which gives many advantages including dense tolerance control, the possibility to integrate all or some parts of the control electronic in a single common substrate of relatively modest size, and gives access to a technology that enables efficient mass production through batch production. Moreover, miniaturization and thereby low mass of the movable parts are possible at the same time as a small thermal mass is obtained, which enables a high transition frequency, if so desired.

Figure 2:
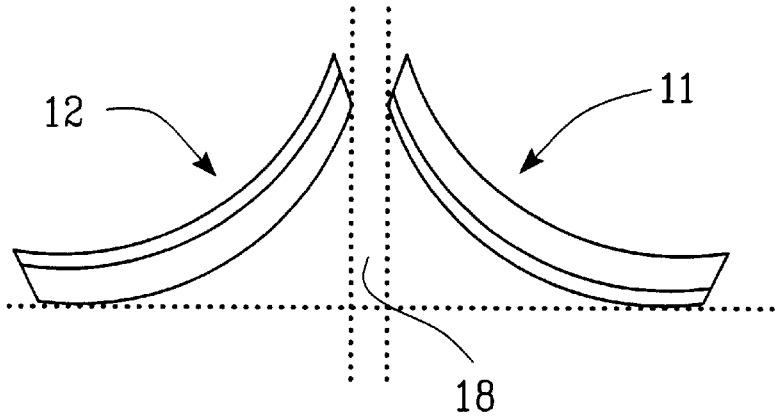
FIG. 2 is a very schematic cross-section of a bistable micromechanical switch during the first phase of a switching from an open to a close position.
Figure 3:
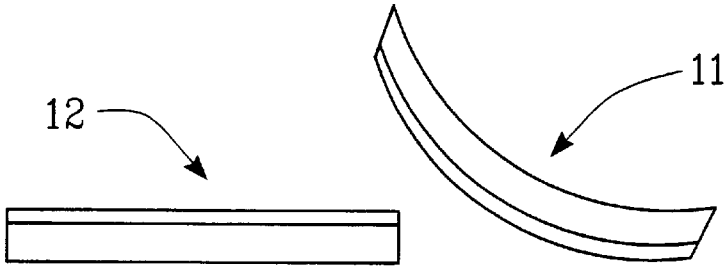
FIG. 3 is a very schematic cross-section of the switch shown in FIG. 2 during a second phase of the switching from an open to a close position.
Figure 4:
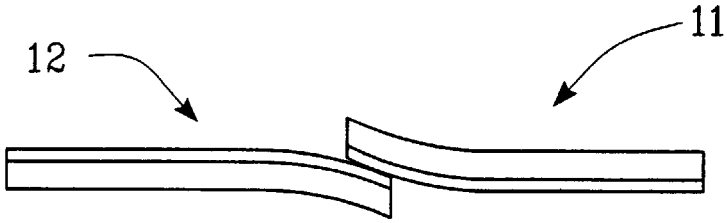
FIG. 4 is a very schematic cross-section of a closed bistable micromechanical switch according to the invention shown in FIG. 2.
Figure 5:
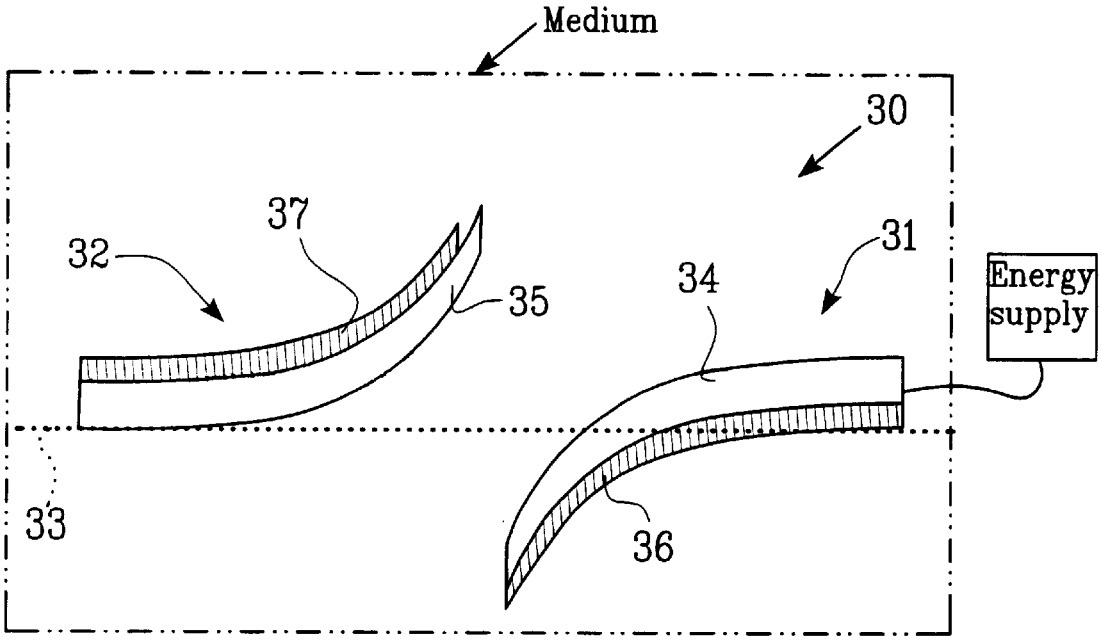
FIGS. 5–8 show very schematically cross-sections of embodiments of an open bistable micromechanical switch, according to the invention, provided with an optical conductor.
Figure 6:
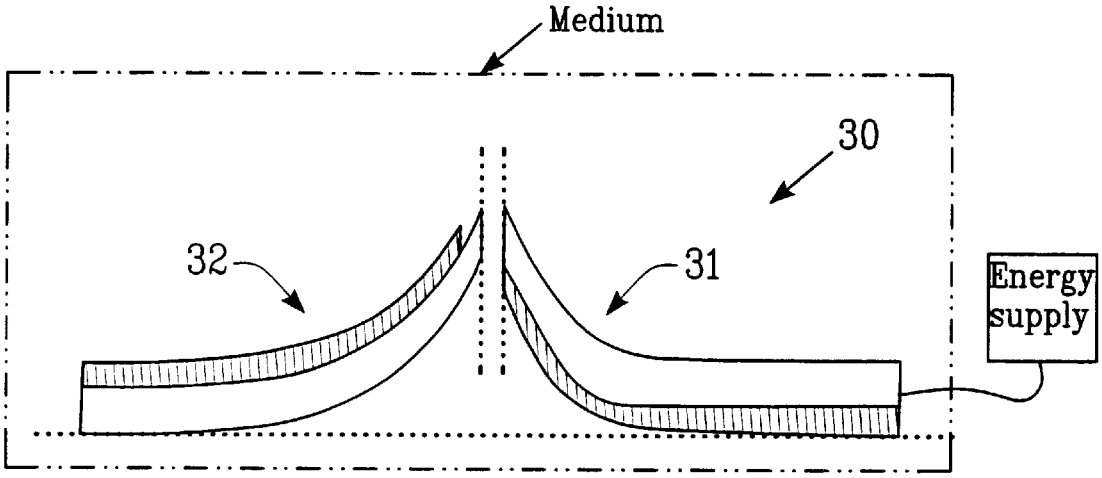
Figure 7:
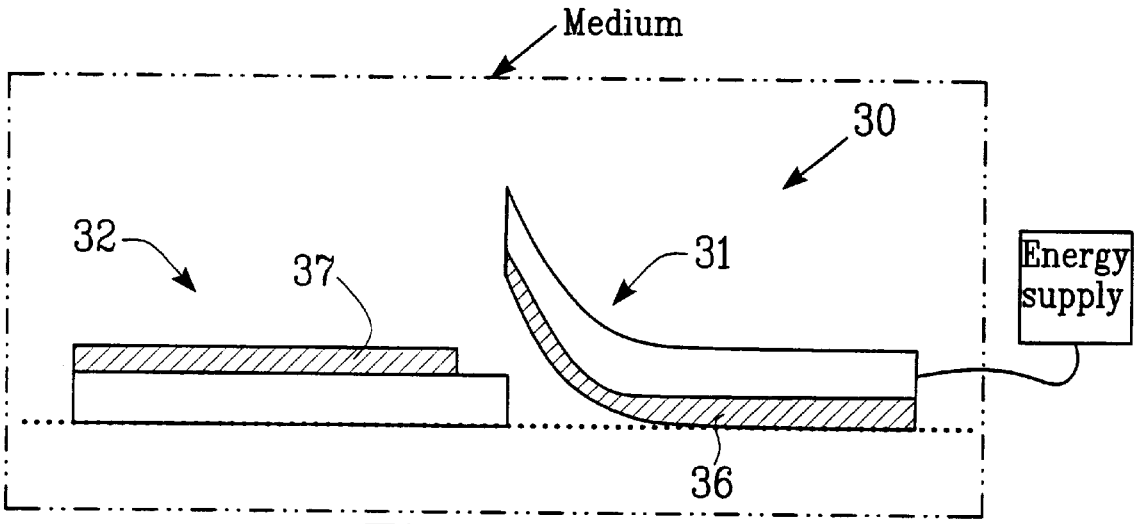

Operation stages for the switch are shown in FIGS. 2–4. To have the switch 10 to close from an open state, if it is so arranged that one arm deflects upwards and one deflects downwards at the operating temperature, for example, first the arm that deflects downwards is heated, which then straightens and then begins to deflect upwards. Heat is produced by means of electrical current, illumination, radiation or the like. The arm is heated so much that it deflects so that it comes in same level as or passes the other arm which normally is bended upwards at the operating temperature. Also, the other arm is heated now so that it deflects downwards towards the straightened position while the first-mentioned arm still is heated so that it deflects upwards. When the other arm is in the straightened state, the first arm is cooled so that it deflects back and straightens until it is stopped by the second arm, which is straightened. The second arm is now cooled, which makes it to try to deflect upwards, but is obstructed by the first arm which in turn wants to deflect downwards but is blocked by the other arm. The switch completes the circuit now and the mechanical tensions in the arms hold the switch locked in a closed position. To open the switch again, the thermal cycle is applied in revers order which forces the switching arms to the open position again.

FIG. 2 shows the first phase in the switching sequence, where the first switching arm 11 is now heated and as the material(s) in the lower part 16 of the arm has (have) higher thermal expansion coefficient than the upper part 14 of the arm, it deflects upwards. The material combination, length and thickness of the arms are so chosen that at an appropriate heating of the first switching arm 11 it deflects upwards in the same level as the second arm 12 and a gap 18 is obtained between the free ends of the arms.

FIG. 3 shows the second phase in the switching sequence, where the first switching arm 11 is still heated. Furthermore, the amount of supplied heat to the other arm 12 is so much that it straightens. When heated, the second arm 12 deflects downwards opposite the first arm since the second arm is so arranged that material(s) in the upper part of the arm has (have) higher thermal expansion coefficient than the lower part.

The position of the arms after completed switching sequence is shown in FIG. 4. The switching is completed from the position in FIG. 3 by cooling the first arm, i.e. stop supplying energy for heating. The first switching arm will then deflect downwards again but since the second arm is now straightened, it will stop the first arm in straightened position. Now, by cooling the second arm, it will try to deflect upwards again, but now it is stopped by the right arm which will deflect downwards, the switch closes in a contact region.

To unlock the switch again, the process is simply reversed. If extra high contact pressure is wanted, the switch can be produced with plates for electrostatic attraction between the switching arms. In this way the forces from the inner tensions in the arms are combined with an electrostatic force.

A device according to invention is not limited for connecting only electrical signals, it may also be considered that one or several layers in the switching arms function as optical conductors, so that the switch functions as an optical connector or switch if so wanted. FIGS. 5–8 show in same way as FIGS. 1–4 a switching device 30, now intended for switching optical signals. The bistable micromechanical optical switch 30, shown in FIG. 5, in an open position including a first and a second switching arm 31 and 32, respectively, is provided on or in a carrier, which was described above. Each arm 31 and 32, respectively, has in same way such a built-in, essentially high mechanical tension that they can be bent by the operating temperature in opposite directions. According to FIG. 5, the first arm 31, e.g. is deflected downwards (or right/left in the plane of the drawing) and the second arm 32 upwards (or right/left in the plane of the drawing) relative to the line 33. Preferably, each arm consists of a first part 34, 35 of one or several different types of material and the second one 36, 37 an optical conducting part, for example of an optical fibre. The material in parts 34, 35 and also the optical conducting parts may have different thermal expansion coefficients. Also, here each arm is secured at one end.

Figure 8:
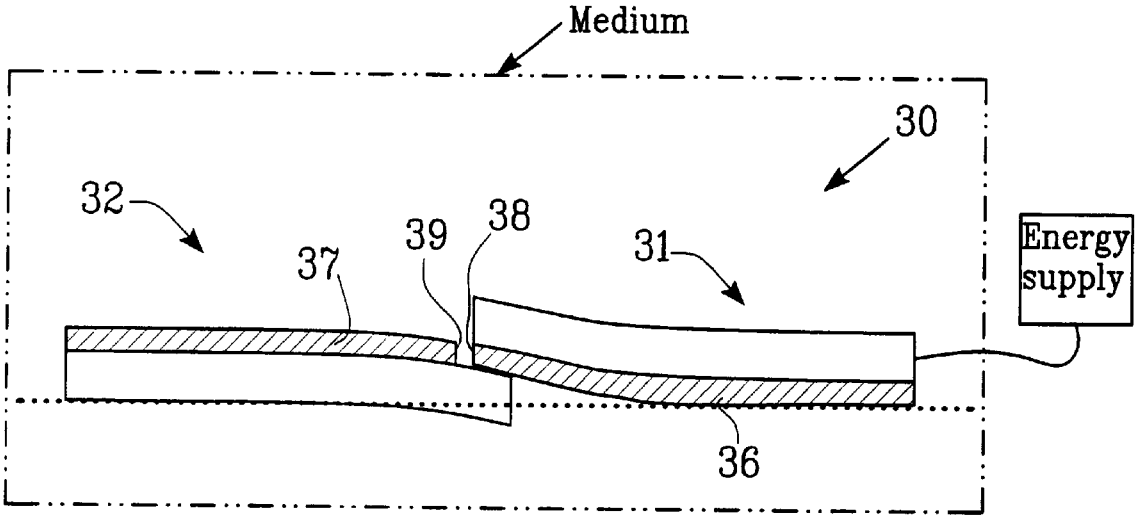

Coupling is accomplished by the optical conducting parts 36, 37 being aligned by means of the arms, i.e. their longitudinal axis at least at their coupling ends 38 and 39, respectively, essentially coincide, as shown in FIG. 8. One end of the arm 32 is partly exposed so that the optical conductor 36 on arm 31 can be aligned with the optical conductor 37. To obtain low loss at switching, it is important that exact alignment of the optical waveguides are achieved. If required, the casing for the optical switch can be filled with a medium, which has same refractive index as the optical waveguides and by that avoid reflections (=losses) and additionally increase the efficiency of the switch.

The optical conductors do not need to be arranged on one side of the arm, but can also be integrated in the arms.

By combining several simple switches of types illustrated in FIGS. 1–8 a more complicated switch can be made and arbitrary matrices of switches can be obtained, which can couple one or more incoming signals to one or more inputs and outputs at same time. Unlike certain electrical switches, a mechanical switch is also direction independended, so that one can control signals in both directions in a mechanical switch, if so wanted. Moreover, when manufacturing, it is possible to provide different arms with different characteristics, e.g., one can allow certain arms to have insulation layers on the contact surface so that only high-frequency signals are coupled and possible direct current is filtered away. Consequently, the switch can, if so wanted, function as a mixer, between HF to HF, HF-DC or between HF and different fixed DC levels which have been coupled to different switching arms.

The device according to the present invention may also be used as a sensor and memory element.

While we have illustrated and described only preferred embodiments of the invention, it is clear that several other variations and modifications within the scope of the appended claims can occur.

What is claimed is:

1. A micro-mechanical switching device comprising at least two contact elements, a first element and a second element, said first and second elements having first and second ends, said first ends of each element being fixed on a carrier along a line and said second ends of each element being movable with respect to said first ends of the corresponding element and at least partly movable relative to each other, said micro-mechanical switching device having a first close circuit position when said second ends contact each other and a second open circuit position when said second ends are spaced apart, said contact elements consisting of at least two materials with essentially different thermal expansion coefficients, said elements at said first position being further arranged to substantially align with overlapping second ends, wherein at least one of said elements comprises a heating member, said elements being arranged to assume said second, open position in opposite sides of said line, and said first closed position is obtained by displacing said first element over said line into a same side as the second element and then displacing both elements to alignment and closed circuit.

2. A device according to claim 1, wherein at least some part of the contact elements has built-in mechanical tensions at an operating temperature.

3. A device according to claim 2, wherein the built-in mechanical tension actuates a contact element to move from another contact element, which can be closed or opened by means of thermal actuation.

4. A device according to claim 1, wherein the device is made bistable, so that it remains in its close or open position without intended thermal actuation.

5. A device according to claim 1, wherein at least the heating member is arranged to enable heating via energy supply, such as electrical current, illumination or the like.

6. A device according to claim 2, wherein the built-in mechanical tension acts to move the contact element from other contact elements, which can be closed by means of thermal actuation.

7. A device according to claim 1, wherein at least some of the contact elements that can contact at least another contact element are cantilevered.

8. A device according to claim 1, wherein the contact elements are made inside and/or on a substrate, for example a silica substrate.

9. A device according to claim 1, wherein the contact elements at least partly consist of a material with high thermal expansion coefficient.

10. A device according to claim 9, wherein said material belongs to group comprising one or several of aluminum, tungsten, gold or copper.

11. A device according to claim 1, wherein the contact elements at least partly consist of material with low thermal expansion coefficients, such as silicon oxide, silicon nitride, silicon carbide, aluminum oxide or the like.

12. A device according to claim 1, being provided as an electrical switch.

13. A device according to claim 1, wherein the contact elements at least partly consist of optically conducting material.

14. A device according to claim 13, wherein the device is an optical switch.

15. A device according to claim 13, wherein at least a section of the contact elements is provided with exposed sections for alignment of the optical conducting materials on each contact element.

16. A device according to claim 13, wherein said device is encapsulated and surrounded by a medium having a refractive index, which corresponds to a refractive index of the optical waveguides.

17. An integrated circuit including a part for conducting electrical signals and a micro-mechanical switching device comprising at least two contact elements, a first element and a second element, said first and second elements having first and second ends, said first ends of each element being fixed on a carrier along a line and said second ends of each element being movable with respect to said first ends of the corresponding element and at least partly movable relative to each other, said micro-mechanical switching device having a first close circuit position when said second ends contact each other and a second open circuit position when said second ends are spaced apart, said contact elements consisting of at least two materials with essentially different thermal expansion coefficients, said elements at said first position being further arranged to substantially align with overlapping second ends, wherein at least one of said elements comprises a heating member, said elements being arranged to assume said second, open position in opposite sides of said line, and said first closed position is obtained by displacing said first element over said line into a same side as the second element and then displacing both elements to alignment and closed circuit.

18. A microwave conductor including a part for conducting of microwave signals and a micro-mechanical switching device comprising at least two contact elements, a first element and a second element, said first and second elements having first and second ends, said first ends of each element being fixed on a carrier along a line and said second ends of each element being movable with respect to said first ends of the corresponding element and at least partly movable relative to each other, said micro-mechanical switching device having a first close circuit position when said second ends contact each other and a second open circuit position when said second ends are spaced apart, said contact elements consisting of at least two materials with essentially different thermal expansion coefficients, said elements at said first position being further arranged to substantially align with overlapping second ends, wherein at least one of said elements comprises a heating member, said elements being arranged to assume said second, open position in opposite sides of said line, and said first closed position is obtained by displacing said first element over said line into a same side as the second element and then displacing both elements to alignment and closed circuit.

19. A method for achieving contact in a micro-mechanical switch including at least a first and a second contact elements, affixed to a carrier along a straight line at least one of the contact elements comprising a heating member, which contact elements are arranged at least partly movable relative to each other and via thermal actuation can be connected to and disconnected from each other, and at least partly comprise of at least two materials with different thermal expansion coefficients, the method comprising the steps of:

displacing said first contact element via thermal actuation by said heating member towards said second contact element so that a gap is obtained between the contact elements, wherein the contacting ends of said contact elements are positioned on opposite sides of said straight line displacing said second contact element via thermal actuation by said heating member in a direction so that an overlap between said first contact element and said second contact element is obtained, and establishing a contact between said first and second contact elements when said first contact element is displaced by means of an inverted thermal actuation back toward its original position.

20. A method according to claim 19, wherein said contact terminates by reversing the order of thermal actuation.

* * * * *